US007074074B2

(12) United States Patent
Zhang et al.

(10) Patent No.: US 7,074,074 B2
(45) Date of Patent: Jul. 11, 2006

(54) CONNECTOR FOR FLEXIBLE PRINTED CIRCUIT

(75) Inventors: Chi Zhang, Kunsan (CN); Ren-Chih Li, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/123,342

(22) Filed: May 5, 2005

(65) Prior Publication Data

US 2006/0128207 A1 Jun. 15, 2006

(30) Foreign Application Priority Data

Dec. 10, 2004 (CN) ..... 2004 2 0054275 U

(51) Int. Cl.
*H01R 9/07* (2006.01)

(52) U.S. Cl. ..... 439/495; 439/260

(58) Field of Classification Search ..... 439/495, 439/260, 496, 492, 499, 357, 358
See application file for complete search history.

(56) References Cited

U.S. PATENT DOCUMENTS

| | | | | |
|---|---|---|---|---|
| 5,213,534 | A * | 5/1993 | Gardner et al. | 439/495 |
| 5,727,968 | A * | 3/1998 | Ito | 439/495 |
| 5,816,845 | A | 10/1998 | Chishima et al. | |
| 6,004,156 | A * | 12/1999 | Roque et al. | 439/495 |
| 6,319,052 | B1 * | 11/2001 | Chang | 439/495 |
| 6,561,843 | B1 * | 5/2003 | Ma et al. | 439/495 |

* cited by examiner

*Primary Examiner*—Hien Vu
(74) *Attorney, Agent, or Firm*—Wei Te Chung

(57) ABSTRACT

A connector (100) includes a housing (1) having a top wall (13), a bottom wall (12) and a pair of opposing side-walls, which cooperate to define a cavity (11) opened to a front face (10) of the housing, and defining two spaced recesses (142, 144) at each side-wall wherein the first recess (142) is adjacent to the front face and the second recess (144) is remote from the front face, and the first recess is upwards opened; terminals (2) loaded in the housing, each terminal having a contact portion protruding into the cavity; and an actuator (3) movably assembled to the housing and comprising a tongue (32) insertable into the cavity and a pair of latches (33) disposed oppositely beside the tongue, each latch provided with an barbed end (331) inserted in the first recess from the upward opening of the first recess and slidable into the second recess.

10 Claims, 8 Drawing Sheets

CONNECTOR FOR FLEXIBLE PRINTED CIRCUIT

CROSS-REFERENCE TO RELATED APPLICATIONS

Relevant subject matter is related to a contemporaneously filed U.S. patent application entitled "CONNECTOR FOR FLEXIBLE PRINTED CIRCUIT", which is invented by the same inventor as this patent application and assigned to the same assignee with this application.

BACKGROUND OF THE INVENTION

1. Field of the Invention

The present invention relates to an electrical connector, and more particularly to an electrical connector for a sheet-like connection member such as a flexible printed circuit or cable (FPC), a flexible flat cable (FFC) and so forth. All of these cables and circuit will be generally referred to as "FPC".

2. Description of Related Art

A conventional FPC connectors generally includes a housing defining a cavity opened to a front face thereof, a plurality of terminals loaded in the housing and extending into the cavity, and an actuator detachably assembled to the housing. The actuator comprises a tongue insertable into the cavity and a pair of side latches oppositely beside the tongue. Each latch has a barbed end which protrudes towards the tongue. The housing is provided with two spaced projections protruding from each side of the cavity for engaging with the barbed end of the latch, wherein the first projection is adjacent to the front face of the housing while the second projection is remote from the front face, and is usually a little larger than the second projection in size. The barbed end is slidable over the two projections successively along a front-to-back direction. When the barbed end is slid over the first projection to be received in a gap between the two projections, the tongue is placed in a provisionally-retained position outside the cavity to form an insertion port for an FPC, and when the barbed end is slid over the second projection, the tongue is placed in a completely-retained position completely inserted in the cavity to thereby hold the terminals in contact with the FPC. However, a split will possibly occurs at a joint of the latch and a base of the actuator since the latches have to be pressed outwardly while the barbed end thereof sliding over the two projections, especially the first projection, viz. the larger projection.

U.S. Pat. No. 5,816,845 discloses another conventional FPC connector which is similar to above-mentioned connector but in which an actuator is assembled to a housing on a slant to avoid the first projection adjacent to the front face. That reduces the possibility of split at a joint of the latch and the base of the actuator. However, this connector is required to provide a number of slanting surfaces to guide and engage with the aslant inserted latch. That complicates the configuration of the connector and thereby increases production cost. On the other hand, as there is no lock mechanism for locking the barbed end of the latch, the actuator tends to withdraw just over the course by which it has come. Thus the actuator will possibly be detached from the housing by unintentional or mistake operation.

It is thus desired to provide an FPC connector with a simple configuration in which latches of an actuator is prevented from splitting away off a base of the actuator in a sense and in which the actuator is reliably assembled to a housing of the connector against being mistakenly withdrawn.

SUMMARY OF THE INVENTION

An object of the present invention is to provide an FPC connector in which an actuator is prevented from getting splitting.

A second object of the present invention is to provide an FPC connector with a simple configuration which can be operated with enhanced efficiency.

A third object of the present invention is to provide an FPC connector in which an actuator is reliably assembled to a housing of the connector against being mistakenly withdrawn.

In order to achieve above-mentioned objects, an FPC connector in accordance with a preferred embodiment of the present invention includes a housing having a top wall, a bottom wall and a pair of opposing side-walls, which cooperate to define a cavity opened to a front face of the housing, and defining two spaced recesses at each side-wall wherein the first recess is adjacent to the front face and the second recess is remote from the front face, and the first recess is upwards opened; a plurality of terminals loaded in the housing, each terminal having a contact portion protruding into the cavity; and an actuator movably assembled to the housing and comprising a tongue insertable into the cavity and a pair of side latches disposed oppositely beside the tongue, each latch provided with an barbed end inserted in the first recess from the upward opening of the first recess and slidable from the first recess into the second recess.

Other objects, advantages and novel features of the present invention will become more apparent from the following detailed description of the present embodiment when taken in conjunction with the accompanying drawings.

DETAILED DESCRIPTION OF THE INVENTION

Figure 1:
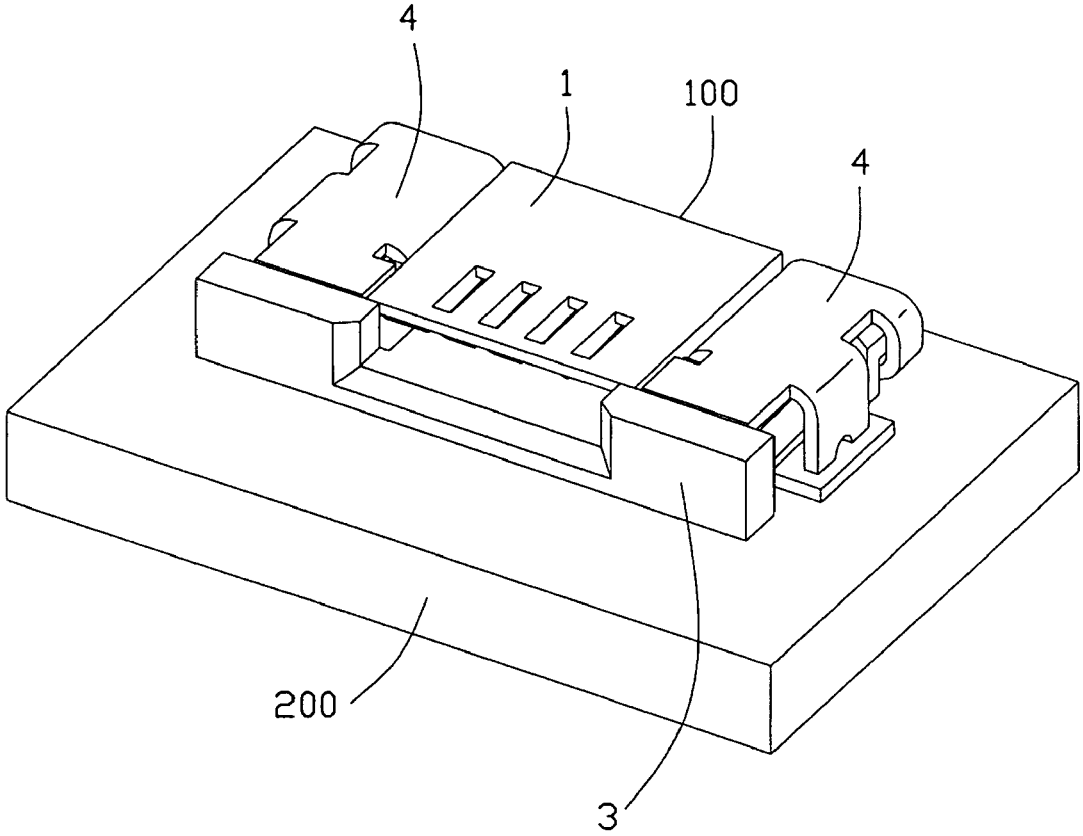
FIG. 1 is an assembled perspective view of an FPC connector mounted on a printed circuit board (PCB) in accordance with the preferred embodiment of the present invention.

Reference will now be made to the drawing figures to describe the preferred embodiment of the present invention in detail.

Referring to FIGS. 1–4, an FPC connector 100 for connecting an FPC to a printed circuit board (PCB) 200 in accordance with the present invention comprises an insulative housing 1, a plurality of terminals 2 loaded in the housing 1, an actuator 3 detachably assembled to the housing 1, and a pair of lock ears 4.

Figure 7:
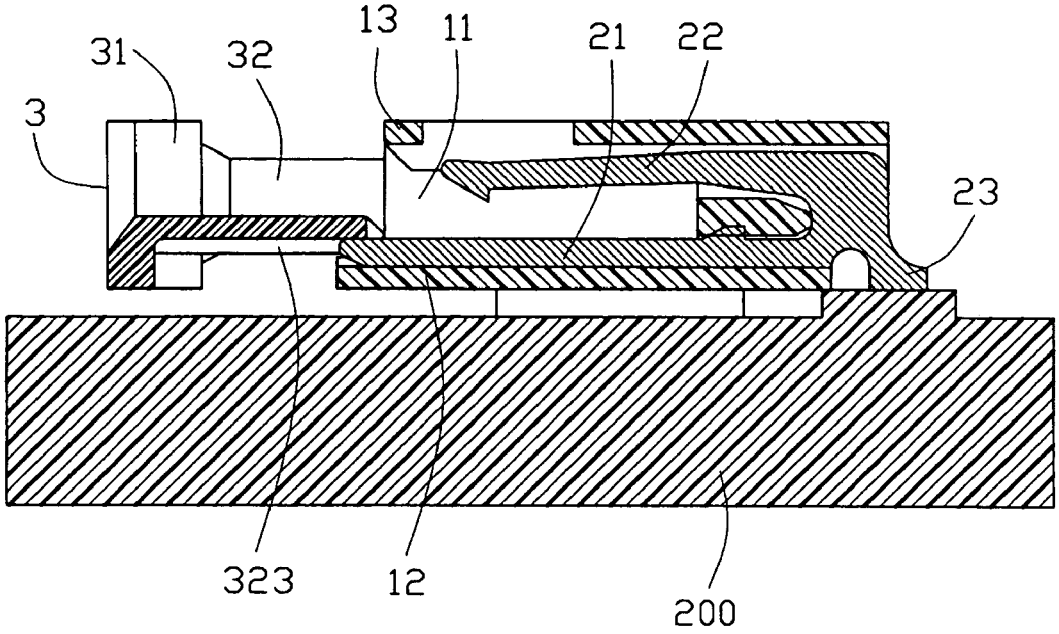
FIG. 7 is a cross-sectional view of the FPC connector of FIG. 6 taken along line 7—7.

The housing 1 comprises a middle portion formed with an upper wall 12 and a lower wall 13 defining a cavity 11 therebetween, and a pair of side portion 14 at two opposite sides of the middle portion. The cavity 11 is opened to a front face 10 of the housing 1 for receiving the actuator 3 and an FPC (not shown). A front-to-back direction perpendicular to the front face 10, along which the FPC is inserted into the cavity 11, is defined as an insertion direction B. In conjunction with reference to FIG. 7, the terminals 2 are inserted into the cavity 11 from a rear portion of the housing 1. Each terminal 2 comprises a fixed arm 21 extending oppositely along the insertion direction B and fixed in the lower wall 13, and an opposing resilient arm 22 extending parallel to the fixed arm 21 and received in the upper wall 13. Each resilient arm 22 has a barbed free end protruding into the cavity. Corresponding to the barbed free ends of the resilient arms 22, the upper wall 13 defines apertures therethrough to provide a space for deflection of the barbed free end. Each terminal 2 also has a tail 23 extending beyond the housing 1 for being soldered to the PCB 200.

Figure 2:
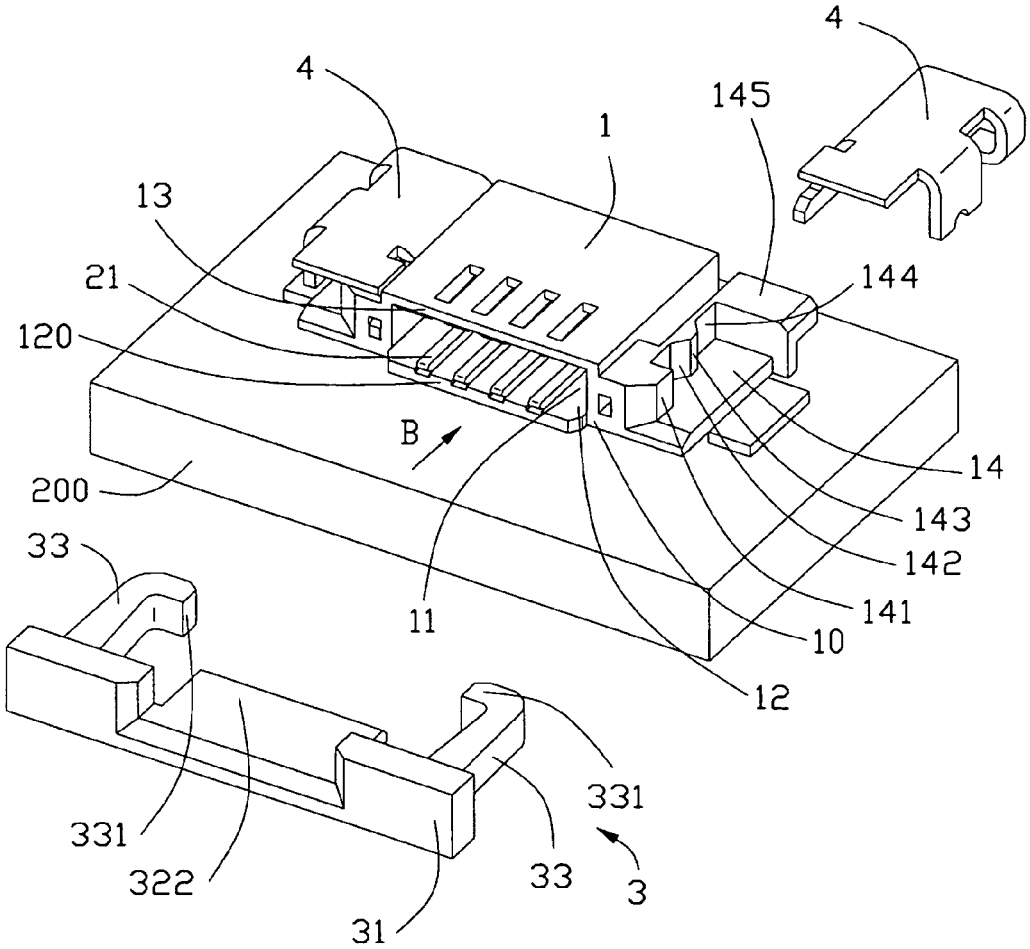
FIG. 2 is an exploded perspective view of the FPC connector of FIG. 1 on the PCB.
Figure 4:
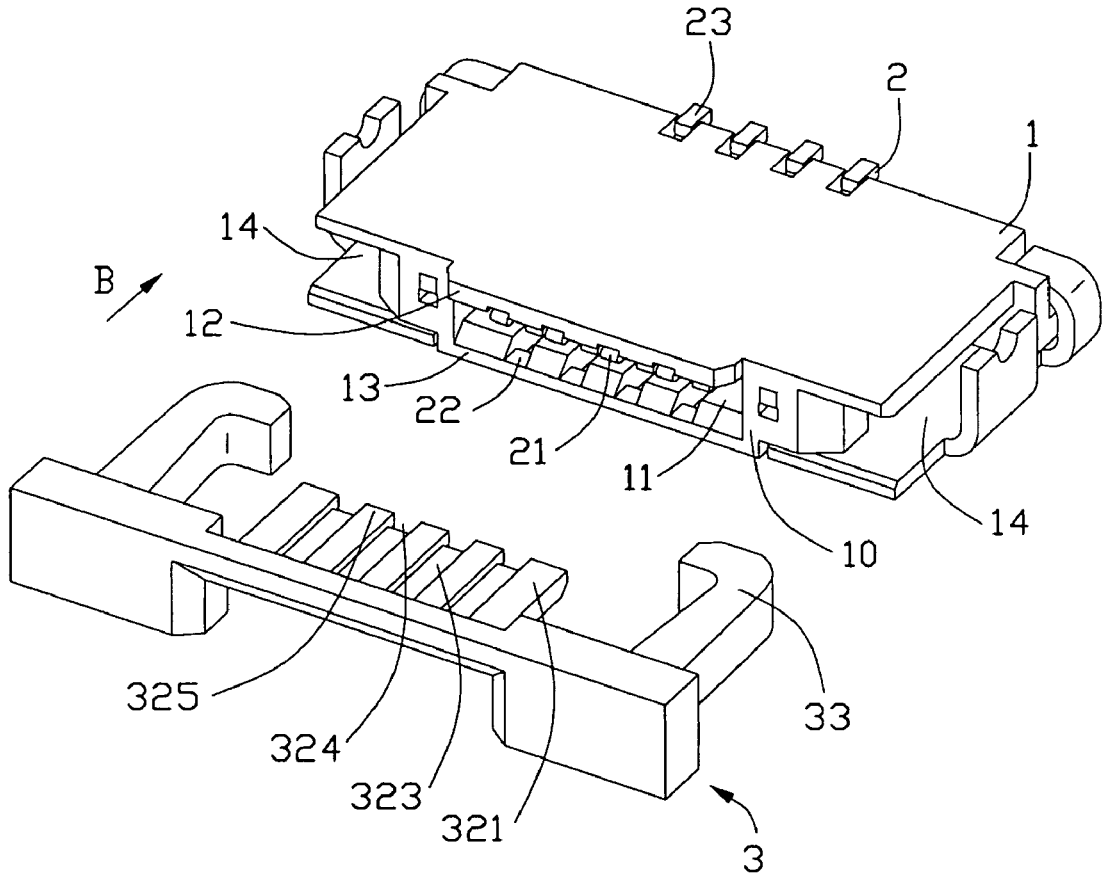
FIG. 4 is an exploded perspective view of the FPC connector of FIG. 1 taken from a third aspect.

As best shown in FIGS. 2 and 4, the lower wall 13 has a front end 120 exposed to exterior, which is realized by the lower wall 13 extending forwards beyond the front face 10 in this preferred embodiment, and which also can be realized by the upper wall 12 backing off a little from the front face 10.

Each side portion 14 of the housing 1 is configured with a first tuber 141, a second tuber 143 and a stop block 145 which are spaced along the insertion direction B. Wherein the first tuber 141 is adjacent to the front face 10 while the second tuber 143 is remote from the front face 10, and the first tuber 141 is larger than the second tuber 143 in size. The two tubers 141, 143 define a first recess 142 therebetween, while the second tuber 143 and the stop block 145 define a second recess 144 therebetween. Both the first recesses 142 and the second recesses 144 are upwards and sidewards opened.

Figure 3:
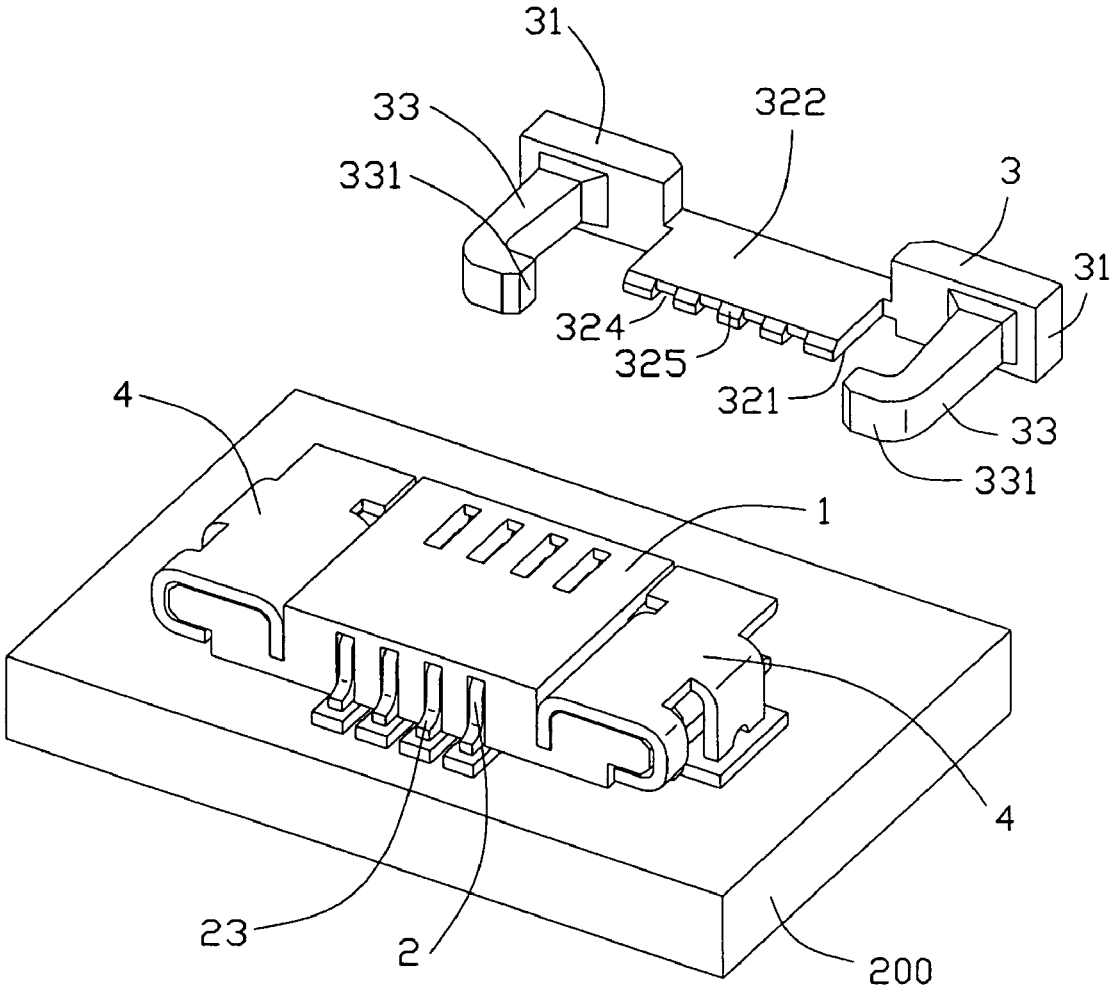
FIG. 3 is an exploded perspective view of the FPC connector of FIG. 1 on the PCB taken from another aspect.
Figure 5:
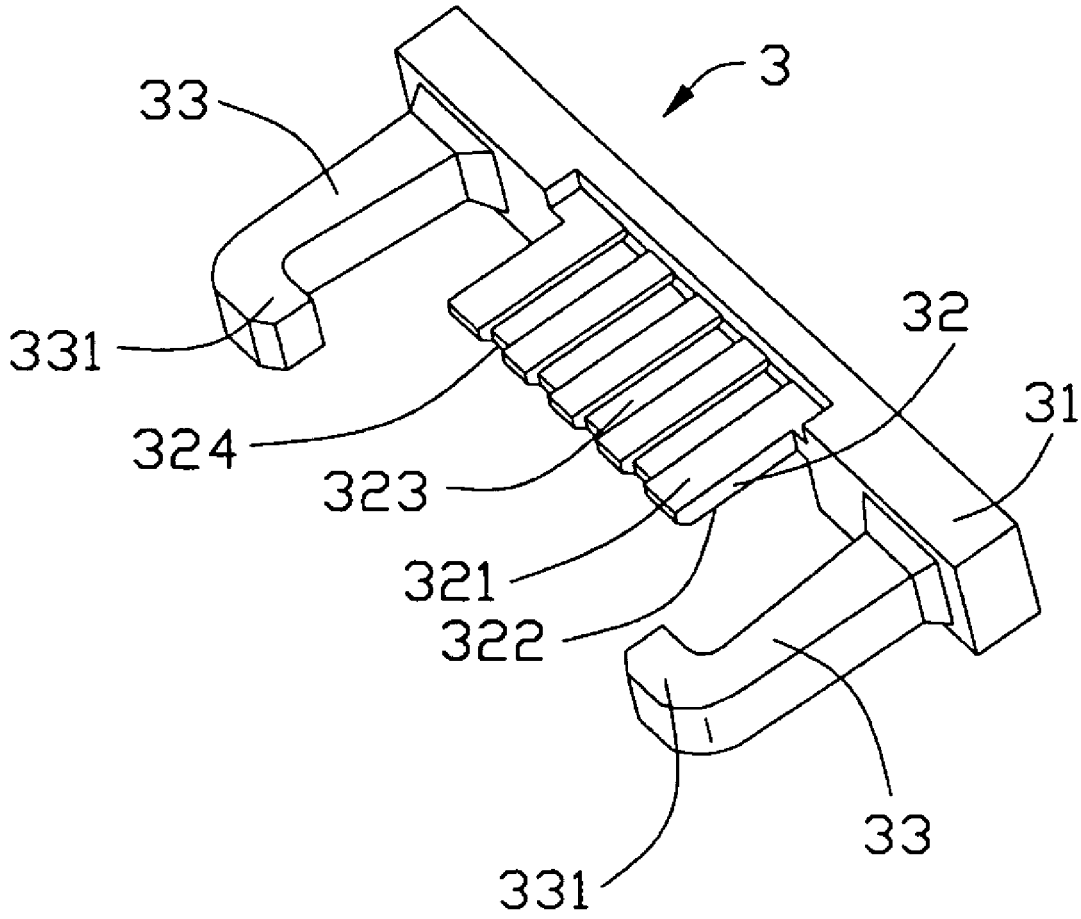
FIG. 5 is a perspective view of an actuator of the FPC connector of FIG. 1.
Figure 6:
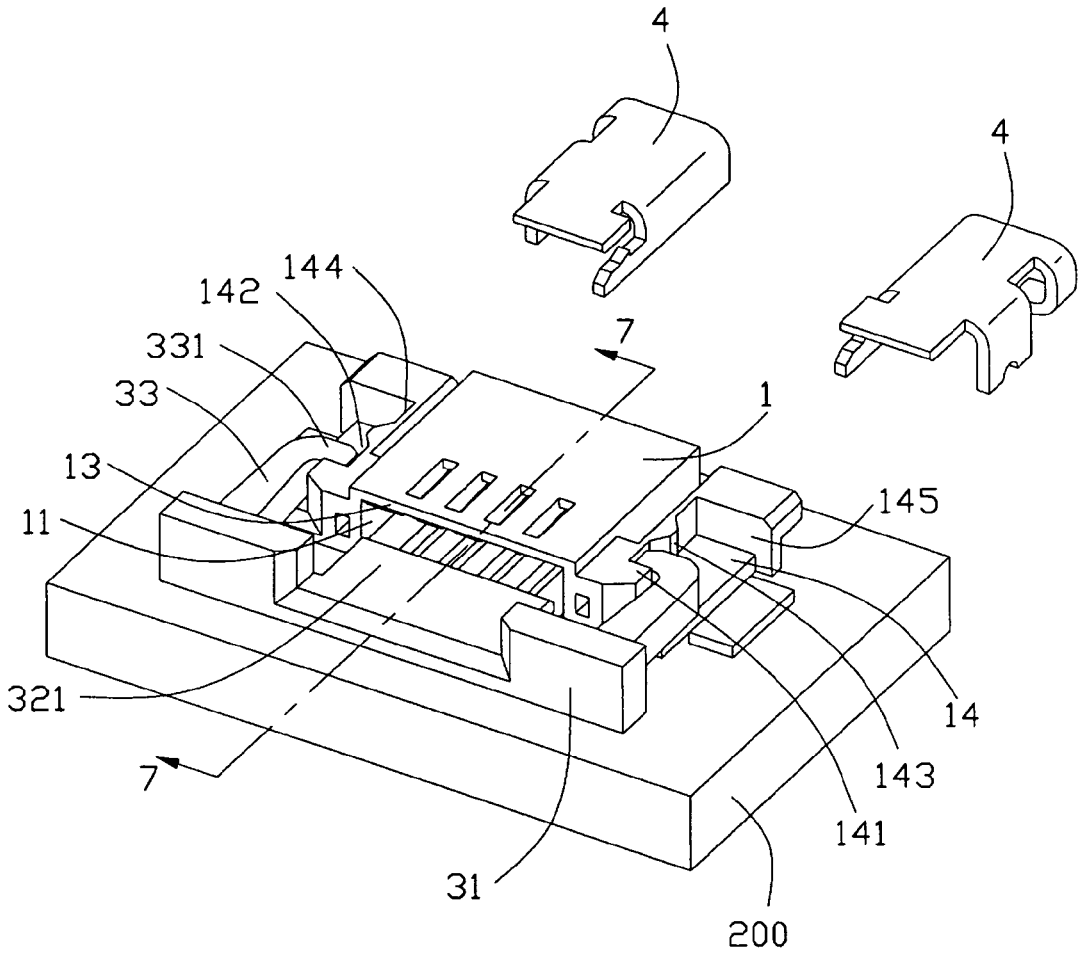
FIG. 6 is a partly assembled, perspective view of the FPC connector of FIG. 1 on the PCB, wherein the actuator is at the open position.

Referring to FIGS. 3 and 5, the actuator 3 comprises an elongated base 31, a tongue 32 extending from a middle section of the base 31, and a pair of side latches 33 extending from two opposite end of the base 31. Each latch 33 has an inwardly protruding barb 331 at a free end thereof. The tongue 32 has an upper surface 322 which is inclined at a front end thereof and an under surface 321 defining a plurality of slots 323 corresponding to the fixed arms 21 of the terminals 2. The slot 323 extends upwards through the upper surface 322 to form a cutout 324 which gives birth to a pair of tips 325 therebeside accordingly. Thus the tongue 32 is provided with a comb-like shape at its front end, which is formed by an alternation of the cutouts 324 and the tips 325.

Referring to FIGS. 2, 4, 6 and 7, the actuator 3 is assembled to the housing 1 from an upside of the housing 1 with the barb 331 thereof vertically inserted into the first recess 142. As a distance between the two opposite barbs 331 is slightly longer than that between bottom surfaces of the two opposite first recesses 142, the barbs 331 will not suffer pressure from the housing 1. Thus the possibility that the latches 33 split away off the base 31 is effectively reduced. Otherwise, as the front end 120 of the lower wall 12 extends forwards beyond the front face 10, an end section of the tongue 32 can vertically moved down to reach the front end 120 without obstruct in its way. After the barb 311 received in the recess 142, the end section of the tongue 32 abuts on the exposed front end 120 of the lower wall 12 and front sections of the fixed arms 21 received in the slots 323 on under surface 321 of the tongue 32. Now the actuator 3 is in an open position relative to the housing 1 to receive the FPC.

Then each lock ears 4 is respectively assembled to the side portion 14 of the housing 1 for covering the upward openings of the first recess 142 and the second recess 144 to prevent the latches 33 from upwardly moving. Each lock ear has a grounding leg (not labeled) extending down to be soldered to the PCB 200. The grounding leg loosely covers the sideward openings of the first recess 142 and the second recess 144 to prevent the barbed end 331 of the latches 33 from coming out of the first recess 142 over the first tuber 141 oppositely along the insertion direction B yet allow it to pass over the second tuber 143 to reach the second recess 144 along the insertion direction B.

Figure 8:
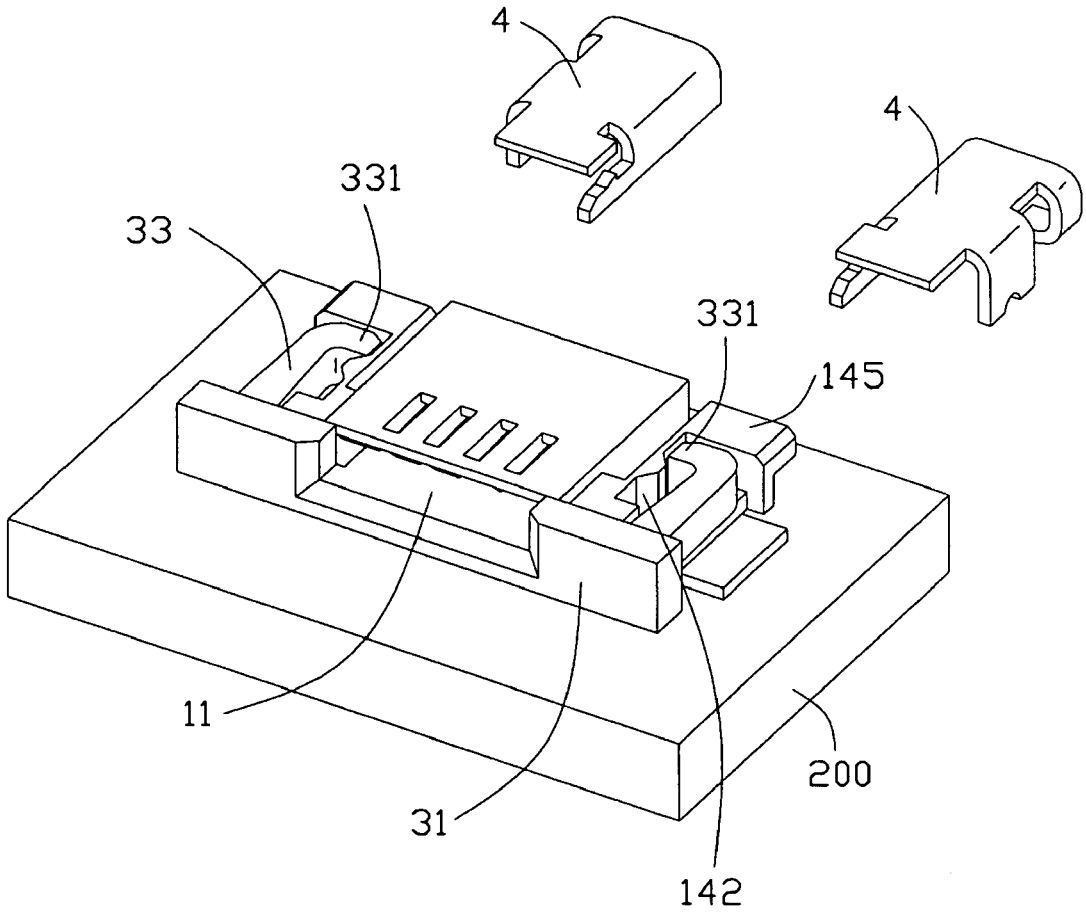
FIG. 8 is a view similar to FIG. 6, but the actuator is at the close position.

After the connector 100 is mounted to the PCB 200, at said open position, for the FPC to be inserted with more convenient, the actuator 3 is tilted by raising the base 31 slightly to form a slant insertion port while the tips 325 of the tongue 32 remain abutting on the front end 120 of the lower wall 12. During this time, the fixed arms 21 of the terminals 2 are received in the cutout 324 of the tongue 32 as if the tips 325 are locked in gaps between fixed arms 21 therefore to prevent the actuator 3 from sidewards moving. Then the FPC is inserted into the cavity 11 of the housing 1 along the upper surface 322 of the tongue 32 from the above-mentioned slant insertion port. At last, the actuator 3 is horizontally pushed to the housing 1 along the insertion direction B with the tongue 32 thereof inserted into the cavity 11 to urge the FPC thereon to electrically connect with the resilient arms 22 of the terminals 2. During this process, the fixed arms 21 of the terminals 2 fitly received in the slots 324 to guide the insertion of the tongue 32. Meanwhile, the latches 33 of the actuator 3 are forcedly slid from the first recess 142 into the second recess 144. Now the actuator 3 is in a closed position relative to the housing 1, as shown in FIG. 8.

Therefore, instead of sliding into the recess 142 over the first tuber 141, the barbs 331 of the latches 33 are vertically inserted into the first recess 142 from the upward opening thereof and thereby are free of pressure from the housing 1, thus in a certain extent the latch 33 can escape from being pressed outwardly. It effectively reduces the possibility of split at a joint of the latch 33 and a base of the actuator 3. On the other hand, via a lock ear 4, the actuator 3 is reliably assembled to a housing of the connector against being mistakenly withdrawn. Additionally, the whole configuration and assembly process of the FPC connector 100 is rather simple. However, the disclosure is illustrative only, changes may be made in detail, especially in matter of shape, size, and arrangement of parts within the principles of the invention.

What is claimed is:

1. An electrical connector for a flexible printed circuit (FPC), comprising:

an insulative housing having a top wall, a bottom wall and a pair of opposing side-walls, which cooperate to define a cavity opened to a front face of the housing, and defining two spaced recesses formed on an outer side at each side-wall wherein the first recess is adjacent to the front face and upwards opened and the second recess is remote from the front face, the bottom wall forwardly extending beyond the top wall to have an front end thereof exposed;

a plurality of terminals loaded in the housing and each having a contact portion protruding into the cavity; and an actuator movably assembled to the housing and comprising a tongue and a pair of side latches disposed oppositely beside the tongue, each latch provided with an barbed end inserted in the first recess from the upward opening of the first recess and slidable from the first recess into the second recess, the tongue having an end thereof abutted on the front end of the bottom wall when the barbed end is in the first recess and insertable into the cavity while the barbed end sliding into the second recess;

wherein the connector further comprises a lock ear assembled to the housing to cover the upward opening of the first and second recesses;

wherein the lock ear has a grounding leg adapt to be soldered to a printed circuit board;

wherein the terminal is provided with a fixed arm fixed on the bottom wall of the housing and partially exposed in the cavity, the fixed arm extending along an insertion direction of the tongue, and wherein the tongue defines slots at an under surface thereof corresponding to the fixed arms.

2. The electrical connector as described in claim 1, wherein both the first and second recesses are sidewards opened.

3. The electrical connector as described in claim 1, wherein a distance between the two opposite barbs is slightly longer than that between the two opposite first recesses.

4. The electrical connector as described in claim 1, wherein the tongue has a comb-like end formed by alternation of cutouts and tip pieces, and wherein each cutout communicating one of the slots.

5. An electrical connector assembly comprising:

an insulative housing defining a cavity therein and a pair of recessed areas on two sides thereof;

a plurality of terminals disposed in the housing and with engagement portions extending into the cavity;

an actuator movably assembled to the housing, said actuator including a tongue moveable within the cavity, and a pair of side latches located by two sides of the tongue and respectively disposed in the corresponding recessed areas; wherein the actuator is initially assembled to the housing in a vertical direction to have the latches retainably received in the corresponding recessed areas and further successively back and forth moveable therein along a front-to-back direction, relative to the housing, perpendicular to said vertical direction due to lateral deflectability of the latches, so as to define open and closed positions of the actuator with regard to the housing;

wherein the housing further defines a protection plane on an exterior side of the corresponding recessed area so as to shield the corresponding latch in a lateral direction perpendicular to both said vertical and front-to-back direction;

wherein said protection plane prevents the corresponding latch from over-deflection so as to prohibit withdrawal of the actuator from the housing in said front-to-back direction;

wherein with cooperation with said protection plane, a front opening defined in a front end of the recessed area is dimensioned small enough not to allow an enlarged head of the corresponding latch to pass for implementing non-withdrawal of the actuator in said front-to-back direction;

wherein said protection plane is provided by a discrete lock ear.

6. The connector as described in claim 5, wherein said lock ear further includes a mounting leg to be fastened to a printed circuit board on which the housing is seated.

7. The connector as described in claim 5, wherein the recessed area defines an upper opening dimensioned large enough to allow an enlarged head of the corresponding lath to pass during vertically assembling the actuator to the housing.

8. The connector as described in claim 7, wherein a discrete lock ear is assembled to each corresponding recessed area to seal said upper opening and protect the corresponding latch in said vertical direction.

9. The connector as described in claim 8, wherein said lock ear further includes a mounting leg to be fastened to a printed circuit board on which the housing is seated.

10. The connector as described in claim 8, wherein said lock ear further defines a lateral side plate to shield both the recessed area and the corresponding latch in a lateral direction perpendicular to both said vertical and front-to-back directions.

* * * * *